United States Patent [19]

Kubis et al.

[11] Patent Number: 4,791,891

[45] Date of Patent: Dec. 20, 1988

[54] RECIPROCATING PISTON ENGINE

[75] Inventors: Heribert Kubis, Nuremberg; Josef Winter, Rednitzhembach, both of Fed. Rep. of Germany

[73] Assignee: MAN Nutzfahrzeuge GmbH, Munich, Fed. Rep. of Germany

[21] Appl. No.: 28,602

[22] Filed: Mar. 20, 1987

[30] Foreign Application Priority Data

Mar. 26, 1986 [DE] Fed. Rep. of Germany ..... 3610147

[51] Int. Cl.[4] ..... F02F 11/10

[52] U.S. Cl. ..... 123/41.84; 123/193 C

[58] Field of Search ..... 123/41.84, 193 C, 193 CH

[56] References Cited

U.S. PATENT DOCUMENTS 3,363,608 1/1968 Scherenberg et al. ..... 123/41.84

3,410,256 11/1968 Herschmann ..... 123/193 CH 4,112,907 9/1978 Nikly ..... 123/193 CH

*Primary Examiner*—Tony M. Argenbright

*Assistant Examiner*—Eric R. Carlberg

*Attorney, Agent, or Firm*—Becker & Becker, Inc.

[57] ABSTRACT

A reciprocating piston engine having a sealing system between the cylinder head and the cylinder liner, or the cylinder block, using a metal gasket. It is proposed to improve such a system in a manner that, while large manufacturing tolerances are permitted, i.e. tolerances on the dimensional design of the cooperating parts as well as on the cylinder head bolt torque, reliable gas-tight sealing of the combustion chamber is ensured at all times. This is essentially achieved in that a circumferential raised portion on the liner flange is the only part that projects beyond the top end (sealing face) of the cylinder block and is matched to the metal gasket in a manner that when the cylinder head is tightened down on the cylinder block, the cylinder head gasket is always stressed above the yield point, with the metal gasket having such a stress/strain characteristic that once the yield point is exceeded, the horizontal deformation range (i.e. where the compressive stress is constant) is as great as possible.

5 Claims, 3 Drawing Sheets

RECIPROCATING PISTON ENGINE

BACKGROUND OF THE INVENTION

1. Field of the Invention

The present invention relates to a reciprocating piston engine having a cylinder block, at least one cylinder head, and at least one replaceable cylinder liner, whereby a piston is slideably disposed in each cylinder liner, and a combustion chamber delimited by the cylinder head, the cylinder liner, and the piston is provided. The cylinder liner is supported by means of a liner shoulder on the cylinder block, and the cylinder head end face of the liner shoulder is provided in the region contiguous to the combustion chamber with a raised edge and in the remaining (outer) area with a recess that is radially open to the outside and is bounded by a circumferential raised portion which is directed towards the cylinder head. Disposed between the latter and the cylinder block is a plate-like cylinder head gasket, of solid metal, that projects into, or is disposed in, said recess.

2. Description of the Prior Art

It is known in reciprocating engines having replaceable wet cylinder liners to use flat or plate-like cylinder head gaskets to prevent leakage of combustion gases between the cylinder liners and the associated cylinder head. Generally, these gaskets consist of a metal-reinforced soft material and are rimmed in the region of the combustion chambers with metallic edges of U-shaped cross section. When the cylinder head is screwed onto the cylinder block, the rim bead of the gasket around the combustion chamber is pressed onto the clamping shoulder of the cylinder liner, with a certain minimum pressure being necessary to ensure satisfactory sealing of the combustion chamber. The necessary concentration of the pressure in the region of the gasket bead relative to the remaining surface of the gasket, which provides sealing of the water and oil passages between the cylinder block and the cylinder head, is generally achieved in that the surface of the cylinder liner on which the gasket bead is seated is provided with a closely toleranced projection above the cylinder block sealing surface.

Drawbacks of this configuration are as follows:

(a) Especially where the liner shoulder bears near the top of the cylinder block, it is necessary to adopt extremely accurate and difficult-to-manufacture tolerances for the depth of the counterbore in the cylinder block and the depth of the liner flange or shoulder.

(b) The thicknesses of the cylinder head gasket, frequently being made up of several layers, in the region of the gasket rim and the remaining surface of the gasket, call for very close matching of the tolerances.

(c) The initial loading of the cylinder head bolts has to be applied within close tolerances.

(d) The inevitable remaining tolerances on dimensions and bolt forces cause a very wide scatter of the compressive forces, especially in the region of the gasket rim bead. The resulting high bearing pressures are liable to cause deformation of the bore of the cylinder liner whereby, at the same time, the abutment in the cylinder block for the liner flange can be overstressed and can fail while, on the other hand, the bearing pressure on the remaining area of the gasket will decrease, which may cause water and oil leakages. Conversely, gas leakage is liable to occur due to an accumulation of tolerances of low bolt forces, and little projection of the flange seated on the cylinder block or a flange that is even lower than the top of the cylinder block.

Therefore, the arrangement described, in particular in the case of modern high-performance engines of light-weight construction with an inevitably low surplus of initial cylinder head bolt loading and simultaneously high combustion chamber pressures, represents only a compromise with substantial disadvantages.

Some improvement of the combustion chamber sealing can be achieved if, instead of the composite cylinder head gasket described initially, a solid sheet of the same thickness is used and is forced into a groove that extends all the way around in the cylinder head in the region where the liner is sealed by a raised portion which extends all the way around on the projecting flange of the cylinder liner, which bears on the cylinder block. As a result, the gas seal is improved, in addition to the pressure acting on the liner sealing flange. At the same time, it is possible—in principle this is also possible in the arrangement described initially—to provide sealing of the water and oil passages between the cylinder block and the cylinder head even more selectively by inserting elastomeric elements. This arrangement enables sealing of the combustion chamber to be effected with lower initial loads for the cylinder head bolts, while avoiding leakages at the water and oil passages, due to the elasticity of the sealing elements.

A drawback of the last-described system is that, just as in the case of the arrangement initially described, the tolerance conditions are liable to result in undesirably high pressures on the sealing face of the cylinder liners, resulting in the aforementioned negative consequences, namely deformation of the cylinder liner bore and overstressing of the cylinder block. Furthermore, the groove in the underside of the cylinder head calls for costly machining on a lathe. Also, accurate and expensive centering of the cylinder head relative to the cylinder liner is necessary to ensure that the raised face on the liner and the groove in the cylinder head coincide. Partial contact of the cylinder head in the remaining area of the gasket is obtained only after the cylinder head has been deformed by tightening of the bolts so that, as a result, there are no clearly defined conditions regarding the cylinder head contact in the remaining area of the gasket.

It is therefore an object of the present invention to avoid the above-described drawbacks in a reciprocating engine of the type initially referred to, without the need for expensive measures to narrow down the tolerances; in other words, a reliable gastight seal for the combustion chamber is to be ensured at all times while permitting large manufacturing tolerances, i.e. tolerances on the dimensional design of cooperating parts and for the cylinder head tightening torques.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The present invention is characterized primarily in that only the circumferential raised portion, in the region of the recess, i.e. the sealing end face of the cylinder liner, projects relative to the end face of the cylinder block, and in that this raised portion is matched up with the cylinder head gasket, which has a defined compressive strength, in such a manner that when the cylinder head is screwed onto the cylinder block, the cylinder head gasket is always stressed beyond the yield point and is interlocked with the raised portion due to plastic deformation, with penetration of the raised portion into the cylinder head gasket being completed as soon as the remaining (outer) area of the gasket comes to bear on the end face of the cylinder block, and with the cylinder head gasket having such a stress/strain characteristic that once the yield point is exceeded, a deformation range exists which has a maximum length on the horizontal part of the curve, i.e. where the compressive stress is constant.

These features avoid undesirably high compressive forces acting on the cylinder liner and the cylinder block; the cylinder liner gasket comes into defined contact with the entire remaining area of the gasket without any additional bending of the cylinder head on the top (sealing face) of the cylinder block. The compressive force transmitted to the raised portion of the cylinder liner is determined only by the defined compressive strength of the steel cylinder head gasket, which can be made to close tolerances. Since, once the yield point is exceeded, the compressive strength of the metal gasket and, consequently, the compressive force transmitted to the cylinder liner remain practically constant independent of the penetration depth (projection of the raised portion), which is subject to scatter due to the tolerances. Moreover, the interlocking action of the raised portion and the cylinder liner additionally secures the liner transversely.

Further advantageous specific features of the present invention will be described in detail subsequently.

DESCRIPTION OF PREFERRED EMBODIMENTS

Figure 1:
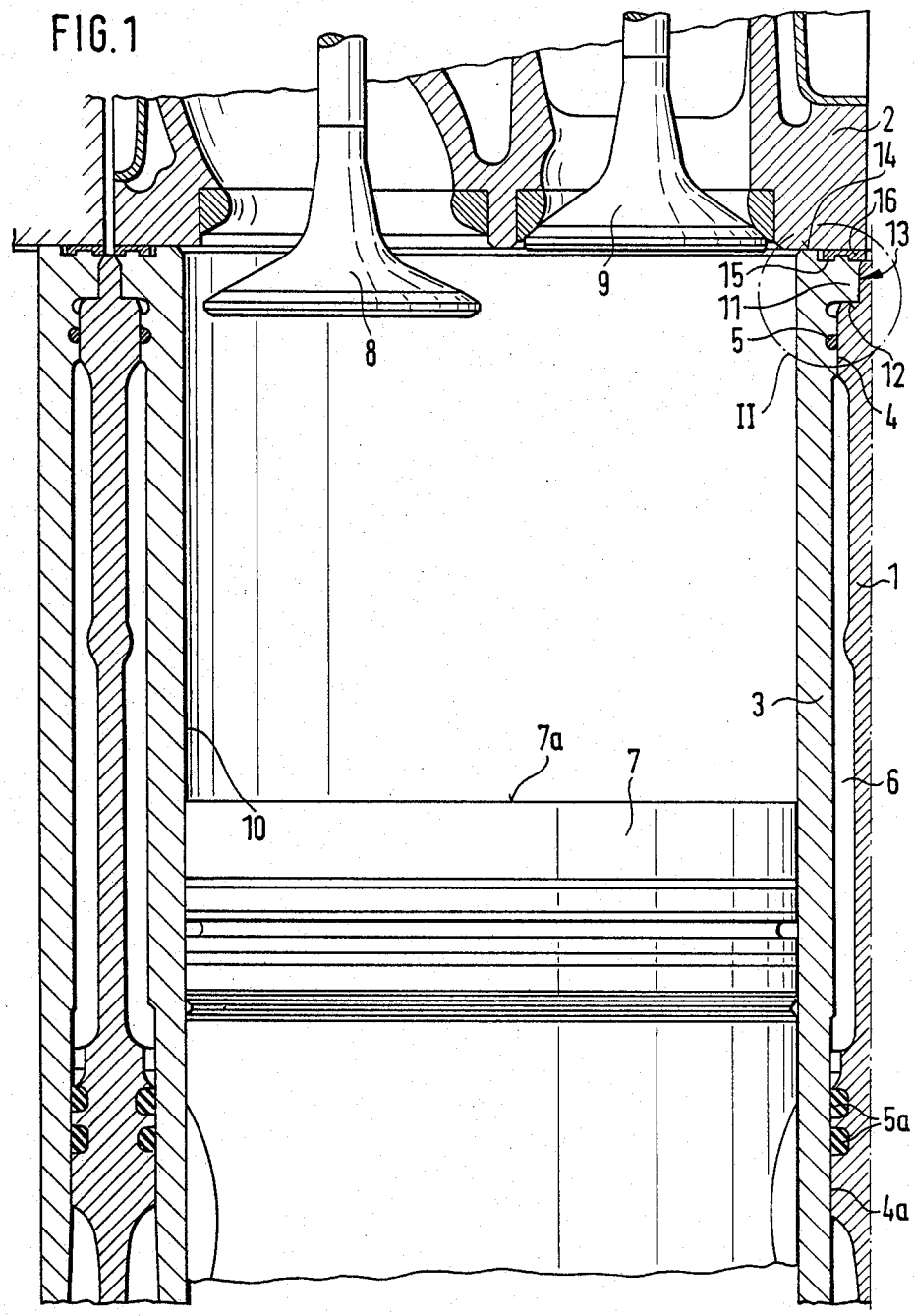
FIG. 1 is a longitudinal cross-sectional view through a reciprocating engine in the region of a cylinder with liner and associated cylinder head, and an appropriate sealing arrangement between these parts.

Referring now to the drawings in detail, FIG. 1 shows a reciprocating piston engine with a cylinder block 1, a cylinder head 2, and a cylinder liner 3. The latter is centrally located by the close fit diameters or seats 4, 4*a* of the cylinder block 1 and, in addition, is sealed by means of gaskets or seals 5, 5*a* relative to a cooling jacket 6. Slideably disposed in the cylinder liner 3 is a piston 7 which is connected in a conventional manner to a crankshaft, which is not shown, via a connecting rod, which is also not shown in the drawing. Formed in the piston crown 7*a* is a combustion chamber cavity (not shown in the drawing) into which fuel is injected in a conventional manner by an injector, which is not shown. The valves 8 and 9 indicated serve for the timing of the reciprocating engine. A combustion chamber, which is not shown, is delimited by the piston crown 7*a*, the cylinder 2, and the associated portion of the inside wall or piston bore 10 of the cylinder liner 3.

At the end contiguous to the cylinder head 2, the cylinder liner 3 is provided with a glange or shoulder 11 which, when secured in place, is seated axially on a radial abutment 12 of a counterbore or recess 13 in the cylinder block 1. A clearance is provided between the outer surface of the liner flange 11 and the inner surface of the counterbore 13.

That end face of the liner flange 11 which faces the cylinder head 2 is provided with a raised edge 14 in the region contiguous to the combustion chamber; this raised edge has only a small clearance relative to the cylinder head 2. The region disposed radially outwardly from the raised edge 14 is provided with an open annular recess 15 in which is disposed a cylinder head gasket 16.

Figure 2:
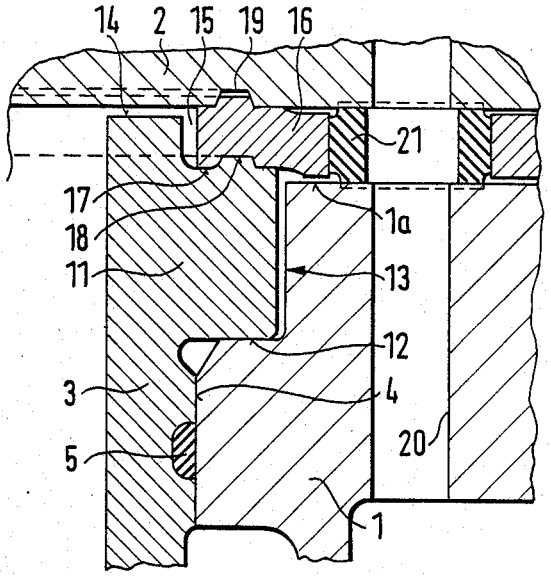
FIG. 2 PRIOR ART
FIG. 2 is an enlarged cross-sectional view of the encircled portion II in FIG. 1 showing a prior art sealing system between the cylinder head and the liner, or the cylinder block, whereby a circumferential portion on the projecting flange of the liner forces the gasket into a circumferential groove in the cylinder head.

FIG. 2 shows a prior art sealing system between the cylinder head 2 and the cylinder liner 3, or the cylinder block 1, which was also described initially. Here, a cylinder head gasket 16 is used which consists of a solid metal sheet (steel sheet) of uniform thickness. The entire gasket seating surface 17 of the cylinder liner 3, i.e. the area of the recess 15 in the liner flange 11, projects beyond the end face 1a of the cylinder block 1. Disposed on the seating surface 17 for the gasket is a circumferential raised portion 18 which is concentric to a circumferential groove 19 in the cylinder head 2. As can be seen from FIG. 2, when the cylinder head bolts are tightened down, the metal gasket 16 is bent in the region of the groove 19 in the cylinder head 2, over the raised portion 18, until the gasket 16 contacts the seating surface 17. In this configuration, partial contact of the cylinder head on the remaining area of the gasket, i.e. in the part of the gasket beyond the liner flange (in other words, in the sealing area between the cylinder block 1 and the cylinder head 2) is achieved only after the cylinder head 2 has been bent by tightening down the bolts. Consequently, there are no clearly defined conditions where the cylinder head bears on the remaining area of the gasket. For selective sealing of the water and oil passages 20 between the cylinder block 1 and the cylinder head 2, FIG. 2 shows conventional-type elastomeric elements 21, the dashed line showing these elements in the non-compressed state.

Figure 3:
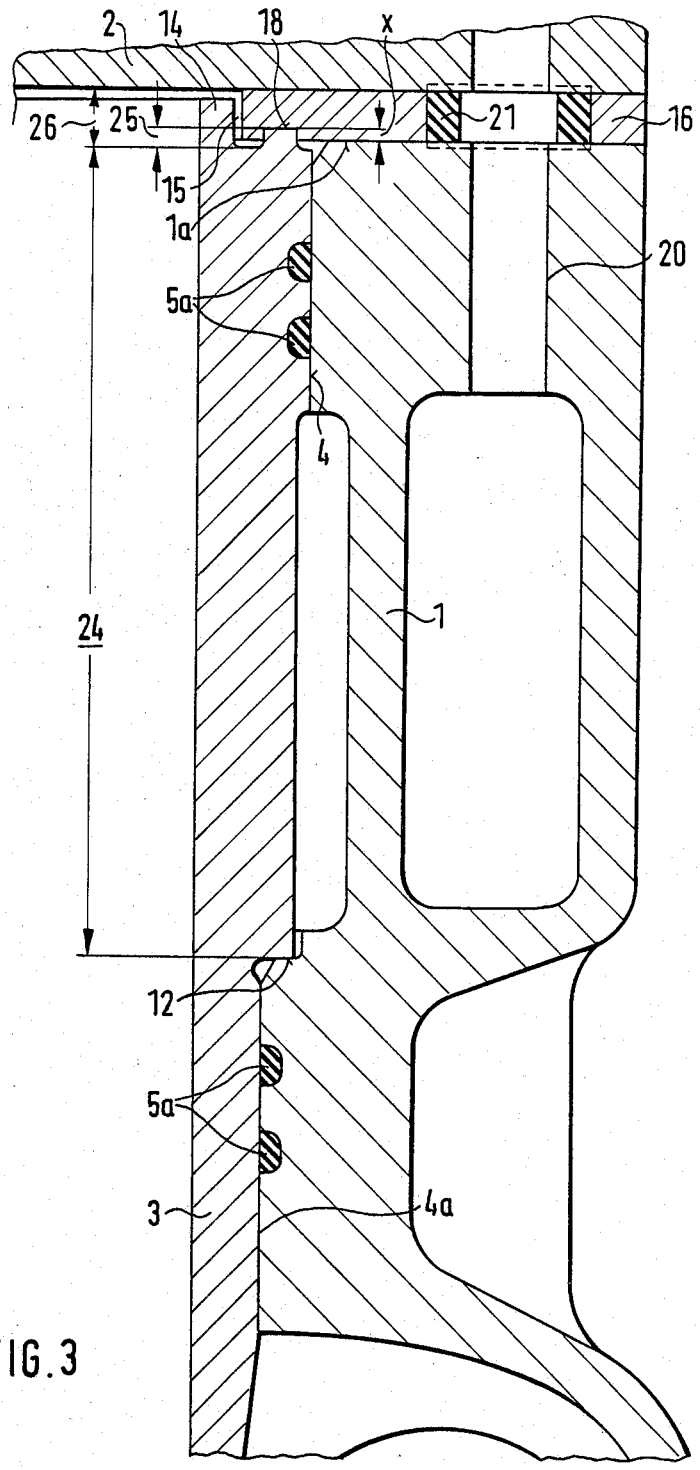
FIG. 3 is a cross-sectional view similar to FIG. 2 of one exemplary embodiment of a sealing system according to the invention in conjunction with a cylinder liner seated on an abutment near the lower end of the liner.

The sealing system of the present invention can be seen from FIG. 3. Since this system offers particular advantages in an engine design where the cylinder liner is seated on an abutment near its bottom end, the invention is illustrated showing this type of construction.

Figure 4:
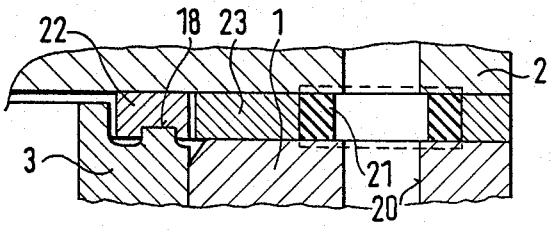
FIG. 4 is a view that shows a modified inventive embodiment of the sealing system shown in FIG. 3.

Similar to FIG. 2, FIG. 3 shows a solid metal sheet of uniform thickness as the cylinder head gasket 16. This metal sheet may consist of steel or another material having similar characteristics. In contrast to FIG. 2, however, only the circumferential raised portion 18 on the liner flange 11 projects by the distance "x" beyond the end face 1*a* of the cylinder block 1. When the cylinder head bolts are tightened down, the raised portion 18 penetrates into the steel sheet until the remaining area of the gasket 16 (i.e. the part of the gasket between the cylinder block 1 and the cylinder head 2) comes to bear on the end face 1a of the cylinder block; i.e. the gasket 16 does not contact the bottom of the recess 15. In the process, the steel sheet 16 is invariably deformed plastically beyond its yield point independent of the tolerances of the projection "x" and the thickness of the gasket. According to the invention, the compressive force acting on the raised portion 18 of the liner flange 11 is such that the steel sheet reaches its limiting strength beyond the yield point, with the compressive force lying within the horizontal part 30 of the material characteristic curve 31 in the stress/strain graph of FIG. 5. Since, once the yield point has been exceeded, the compressive strength of the steel sheet 16 and, consequently, the compressive force transmitted to the liner 3, remain practically constant independent of the penetration depth "x" which is subject to scatter due to the tolerances, the compressive force transmitted via the raised portion 18 is determined only by the defined compressive strength of the steel sheet 16, which can be economically produced within close tolerances. The compressive strength of the steel sheet 16, which is less than that of the raised portion 18, as well as the width of the latter, are selected in such a way that the resulting bearing pressure is a multiple of the maximum gas pressure in the cylinder; this is necessary to obtain a fully satisfactory gastight sealing of the combustion chamber. At the same time, the cylinder liner 3 is fixed transversely in the cylinder block 1 by the interlocking action of the raised portion 18.

Where such fixing action is not desirable, gastight sealing of the combustion chamber in the region of the cylinder liner may be effected alternatively as shown in FIG. 4 by an annular gasket 22 that is separate from the gasket 23 forming the outer gasket. The two gasket parts 22, 23 may be made of different materials, and may have different thicknesses.

The advantage of the engine design having a "clamped" cylinder liner 3 seated on the abutment 12 in the lower part of the cylinder block 1 is in the fact that the susceptibility of the liner to unacceptable deformation from compressive forces applied through the cylinder head gasket 16 is obviated because the invention avoids the need for high compressive forces to take care of the tolerances. As a result, the sealing system of the present invention, in addition to ensuring effective sealing of the combustion chamber, also maintains satisfactory "roundness" of the liner bore.

On dynamic loading of the sealing system by the gas pressure, the tendency of the cylinder head 2 to be lifted off causes the bearing pressure on the raised portion 18, as well as on the shoulder or abutment 12 on which the liner is seated, to be reduced, whereby both the firm seating of the cylinder liner 3 and the effectiveness of the gastight seal are liable to be affected. Another—very general—advantage of a liner seated on an abutment near its lower end is in the fact that the dynamic bearing pressure reduction, due to the great elastically clamped length 24 of the liner 3, tends to be much less than in the case of top-seated liners because the liner 3, when elastically clamped over a great length, will much better compensate the lift-off tendency of the cylinder head 2 than will a liner which is clamped over only a short length.

A reduction in bearing pressure in the sealing system, apart from the reduction caused by the lift-off tendency of the cylinder head 2, may occur additionally and locally by pulsating spherical bending (breathing) of the cylinder head 2, which is held down pointwise by the bolts. The local reduction in bearing pressure caused by such bending of the cylinder head 2 (due to pulsating maximum pressures in the combustion chamber) cannot be compensated for by a liner 3 which is clamped elastically over the length 24. Therefore, the height 25 of the circumferential raised portion 18, and the thickness of the steel sheet 16, are such that the elastically clamped sealing height 26 resulting after installation is sufficient, due to elastic spring action, to avoid unacceptable local reduction in bearing pressure.

Figure 5:
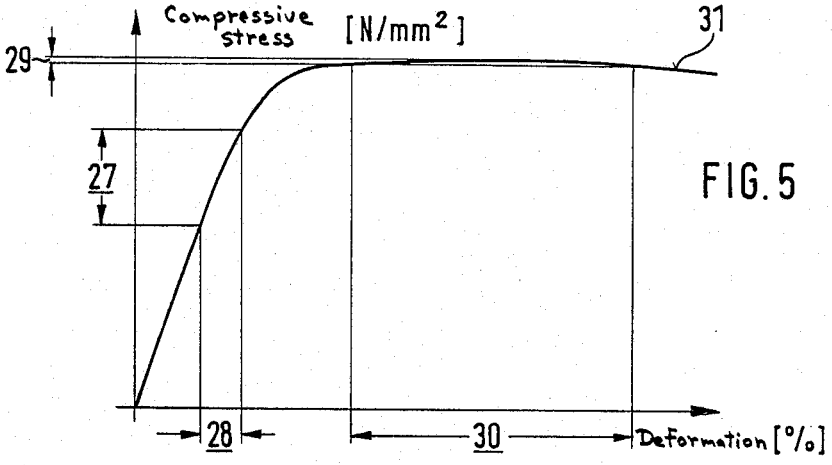
FIG. 5 is a view which provides a graphic representation of the relationship between compressive stress and deformation of the cylinder head gasket used in FIGS. 3 and 4.

FIG. 5 shows a stress/strain graph for compression. Plotted on the ordinate is the compressive stress in $N/mm^2$, and on the abscissa the deformation in per cent. In this graph, a very definite material characteristic curve 31 is obtained for the cylinder-head metal gasket used (steel gasket with defined characteristic or other gasket materials with a similar characteristic). This curve shows that the range 27 (showing a wide pitch-dependent compressive stress range) produces only a narrow deformation range 28. In contrast to this, once the yield point is exceeded, only small differences 29 occur in the compressive stress; however, material deformation, or rather the deformation range 30, is very large. The horizontal part 30 of the material characteristic curve 31 thus ensures a practically constant compressive force acting the cylinder liner 3.

The sealing system of the present invention ensures a gastight seal of the combustion chamber, which is especially suitable for modern high pressure engines (engines with high supercharging and high gas pressures), while maintaining good "roundness" of the liner bore, which is particularly important for reliable long-time operation.

It is obvious that other sealing applications with similar problems can also be solved by means of the sealing system of the present invention. It is also possible to provide the circumferential raised portion 18 on the cylinder head 2 instead of on the liner 3.

The present invention is, of course, in no way restricted to the specific disclosure of the specification and drawings, but also encompasses any modifications within the scope of the appended claims.

What we claim is:

1. In a reciprocating piston engine having cooperating parts including a cylinder block, at least one cylinder head that can be securely tightened to said cylinder block, and at least one replaceable cylinder liner, whereby in each cylinder liner there is slideably disposed a respective piston and a combustion chamber is provided that is delimited by said cylinder head, said cylinder liner, and said piston, with said cylinder liner being supported on said cylinder block via a liner shoulder, and with that end face of said liner shoulder that faces said cylinder head being provided with a first raised edge portion in that portion of said end face contiguous to said combustion chamber, and also being provided with a radially outwardly open recess, which has a base, in the remaining portion of said liner shoulder end face, with the latter further being provided in said recess region with a circumferential second raised portion that is directed toward said cylinder head, whereby a continuous plate-like cylinder head gasket, made of solid metal, is disposed in said recess between said cylinder head and said cylinder block, the improvement in combination therewith wherein:

only said second raised portion, and not said base of said recess, extends and includes a projection having a penetration depth for a distance, in the direction toward said cylinder head, as well as being located above said base of said recess and via only said projection for a distance of penetration depth relative to as well as beyond an end face of said cylinder block that faces said cylinder head; and wherein said cylinder head gasket has a defined compressive strength of the gasket with full surface seal support exclusively between said cylinder head and said cylinder block, and said second raised portion is matched with said cylinder head gasket in such a way that when said cylinder head is secured to said cylinder block, said gasket is always stressed beyond the yield point and is positively interlocked with said second raised portion due to plastic deformation at a quantitatively regulated pressure force dependent exclusively upon flow limit of the gasket in a region of said projection whereas gasket regions to the left and right thereof have no engagement with the cylinder liner, with said penetration of said second raised portion into said cylinder head gasket being completed as soon as a remaining portion of said gasket comes into contact with said end face of said cylinder block, and with said cylinder head gasket having such a stress/strain characteristic that once said yield point is exceeded, a maximum, substantially constant compressive strength deformation range exists for an always reliable sealing of said combustion chamber while enduring dimensional manufacturing tolerances of cooperating parts as well as tolerances in cylinder head tightening.

2. A reciprocating engine according to claim 1, in which the height or projection of said circumferential second raised portion, and the thickness of said metal cylinder head gasket, are such that after installation, an elastically clamped sealing height results that is sufficient, due to elastic spring action, to avoid unacceptable local reductions in bearing pressure.

3. In a reciprocating piston engine having a cylinder block, at least one cylinder head, and at least one replaceable cylinder liner, whereby in each cylinder liner there is slideably disposed a respective piston and a combustion chamber is provided that is delimited by said cylinder head, said cylinder liner, and said piston, with said cylinder liner being supported on said cylinder block via a liner shoulder, and with that end face of said liner shoulder that faces said cylinder head being provided with a first raised edge portion in that portion of said end face contiguous to said combustion chamber, and also being provided with a radially outwardly open recess, which has a base, in the remaining portion of said liner shoulder end face, with the latter further being provided in said recess region with a circumferential second raised portion that is directed toward said cylinder head, whereby a continuous plate-like cylinder head gasket, made of solid metal, is disposed in said recess between said cylinder head and said cylinder block, the improvement in combination therewith wherein:

only said second raised portion, and not said base of said recess, extends and includes a projection having a penetration depth for a distance, in the direction toward said cylinder head, via only said projection for a distance of penetration depth relative to as well as beyond an end face of said cylinder block that faces said cylinder head; and wherein said cylinder head gasket has a defined compressive strength with full surface seal support between said cylinder head and said cylinder block, and said second raised portion is matched with said cylinder head gasket in such a way that when said cylinder head is secured to said cylinder block, said gasket is always stressed beyond the yield point and is positively interlocked with said second raised portion due to plastic deformation at a quantitatively regulated pressure force dependent exclusively upon flow limit of the gasket in a region of said projection whereas gasket regions to the left and right thereof have no engagement with the cylinder liner, with penetration of said second raised portion into said cylinder head gasket being completed as soon as a remaining portion of said gasket comes into contact with said end face of said cylinder block, and with said cylinder head gasket having such a stress/strain characteristic that once said yield point is exceeded, a maximum, substantially constant compressive strength deformation range exists, the height or projection of said circumferential second raised portion, and the thickness of said metal cylinder head gasket, are such that after installation, an elastically clamped sealing height results that is sufficient, due to elastic spring action, to avoid unacceptable local reductions in bearing pressure, said cylinder head gasket comprising two separate members, namely a sealing ring member that is disposed between said cylinder head and said liner shoulder to effect said interlocking with said circumferential second raised portion, and a further sealing member that is disposed between said cylinder head and said end face of said cylinder block.

4. A reciprocating engine according to claim 3, in which said sealing ring member and said further sealing member are made of different materials.

5. A reciprocating engine according to claim 4, in which said sealing ring member and said further sealing member also have different thicknesses.

* * * * *